United States Patent [19]

Matsumura et al.

[11] 4,001,382

[45] Jan. 4, 1977

[54] PROCESS FOR PRODUCING CARBON FIBERS HAVING EXCELLENT PHYSICAL PROPERTIES

[75] Inventors: Yasuo Matsumura; Soichiro Kishimoto; Saburo Okazaki, all of Okayama, Japan

[73] Assignee: Japan Exlan Company Limited, Japan

[22] Filed: Jan. 20, 1975

[21] Appl. No.: 543,008

[30] Foreign Application Priority Data

Feb. 4, 1974 Japan ..... 49-14209

[52] U.S. Cl. ..... 423/447.1; 8/115.5; 264/29.2

[51] Int. Cl.[2] ..... C01B 31/07

[58] Field of Search ..... 423/447; 8/115.5; 264/29, 182

[56] References Cited

UNITED STATES PATENTS

| | | | |
|---|---|---|---|
| 3,027,222 | 3/1962 | Wilkinson | 423/447 UX |
| 3,491,179 | 1/1970 | Chinai et al. | 264/182 X |
| 3,592,595 | 7/1971 | Gump et al. | 423/447 |
| 3,635,675 | 1/1972 | Ezekial | 423/447 |
| 3,681,004 | 8/1972 | Torrance | 8/115.5 X |
| 3,746,560 | 7/1973 | Goan et al. | 423/447 X |
| 3,764,662 | 10/1973 | Roberts | 423/447 |
| 3,776,829 | 12/1973 | Goan | 423/447 X |
| 3,791,840 | 2/1974 | Barr | 423/447 X |
| 3,817,700 | 6/1974 | Menikheim | 8/115.5 |
| 3,841,079 | 10/1974 | Ram et al. | 423/447 |
| 3,954,947 | 5/1976 | Didchenko et al. | 423/447 |

FOREIGN PATENTS OR APPLICATIONS

| | | | |
|---|---|---|---|
| 47-24185 | 6/1972 | Japan | 423/477 |

*Primary Examiner*—Edward J. Meros
*Attorney, Agent, or Firm*—Wenderoth, Lind & Ponack

[57] ABSTRACT

Carbon fibers having excellent physical properties are produced by a process which comprises heating acrylonitrile copolymer fibers made from an acrylonitrile copolymer produced by copolymerizing at least 80 mole % acrylonitrile and 0.3 to 6 mole % of an unsaturated monomer containing a carboxyl group and in which 0.1 to 15% of the terminal hydrogens of said carboxyl groups have been replaced with alkali metal cations or ammonium ions.

10 Claims, No Drawings

PROCESS FOR PRODUCING CARBON FIBERS HAVING EXCELLENT PHYSICAL PROPERTIES

This invention relates to an improved process for producing carbon fibers (including graphite fibers) from acrylonitrilic fibers and more particularly to a process for industrially advantageously producing carbon fibers having a very high tensile strength and modulus of elasticity within a short firing or heating time by heating acrylonitrile copolymer fibers wherein a specific amount of carboxyl groups contained in the copolymer has been converted to the form of a salt (i.e. -COOX wherein X is an alkali metal cation or ammonium ion).

It is known that carbon fibers useful as reinforcing materials, exothermic elements and heat-resistant materials are obtained by heating acrylonitrilic fibers to 200° to 400° C. in an oxidizing atmosphere so as to be cyclized or preoxidized and then heating them at a high temperature (usually above 800° C.) in a nonoxidizing atmosphere.

However, the step of first heating acrylonitrilic fibers in an oxidizing atmosphere so that a cyclized structure of a polynaphtyridine ring is formed in the fibers or so-called thermal stabilization step is a very important step influencing the physical properties of the resulting carbon fibers which are final products. It has been considered that this step requires a heating operation for a long time and therefore is a cause of the low productivity of carbon fibers.

In the case of conducting the thermal-stabilization step at a high temperature or in the case of heating the fibers at a very fast rate of rise of temperature, such quick reactions as an intermolecular cross-linking and intramolecular cyclization will occur at a temperature near the exothermic transition point of the fibers, causing a local heat regeneration, so that nonuniform reactions such as the formation of a pitch or tarry substance, with a result that the fibers will fuse with each other and the physical properties of the carbon fibers are adversely affected.

Therefore, in order to promote such cyclizing reaction to obtain thermally stabilized fibers within a short time, various methods have been suggested. Thus there have been proposed those methods wherein a special comonomer component is introduced into fiber forming polymer, or wherein a special or detrimental chemical treatment is employed, or wherein a complicate thermal-stabilization treatment is required. Thus they have not always contributed to the improvement of the economy and industrial productivity of carbon fibers. Among them, the method wherein acrylonitrile copolymer fibers containing, as copolymerized, an unsaturated monomer containing a carboxyl group are used as precursors is advantageous in respect of the reduction of the firing or heat treatment time because, when such comonomer component is introduced, the exothermic transition point of the fibers will reduce and, when heated, the fibers will become easy to condense and cyclize. However, in respect of the quality, the resulting carbon fibers have no sufficient physical properties.

We have found that, when acrylonitrile copolymer fibers in which a specific amount of carboxyl groups contained in the fiber forming polymer is in the form of a salt represented by -COOX (wherein X is an alkali metal cation or ammonium ion) are used as precursors and are fired or heated, the firing (or heating) time can be remarkably reduced, and carbon fibers of a very high strength and modulus of elasticity can be industrially produced.

Therefore the principal object of the present invention is to industrially advantageously obtain carbon fibers having excellent physical properties.

Another object of the present invention is to obtain carbon fibers of a high strength and high modulus of elasticity within a short time of heating.

Another object of the present invention is to obtain carbon fibers with excellent properties (inclusive high flexibility) by using acrylonitrile copolymer fibers containing carboxyl groups and a specific amount of their salts as precursors so that a quick and uniform thermal-stabilization can be effected without mutual fusion of the fibers.

Other objects of the present invention will become apparent from the following description.

The above mentioned objects of the present invention can be attained by firing or heating acrylonitrile copolymer fibers made of an acrylonitrile copolymer containing, as copolymerized, 0.3 to 6 mol % of an unsaturated monomer containing a carboxyl group and in which 0.1 to 15% of the terminal hydrogens of said carboxyl groups is replaced with an alkali metal cation or ammonium ion, and then carbonizing and/or graphitizing the same in the usual manner.

Thus the novel and important feature of the present invention is in the use, as precursors, of acrylonitrile copolymer fibers in which both of carboxyl groups (-COOH) and their salt form (-COOX) are contained and the content of said salt (-COOX) is 0.1 to 15 mol % or preferably 0.5 to 10 mol % on the total amount of the carboxyl groups (-COOH) and salts (-COOX), so that the cyclizing reaction or cross-linking reaction caused in the thermal-stabilization step is accelerated and made to proceed uniformly. Therefore the thermal-stabilization step can be conducted at a high temperature or quick temperature elevating operation may be adopted, with a result that the heating or firing time can be shortened, the formation of impurities such as pitch and tarry substance in the firing or heating process may be prevented, and therefore carbon fibers having a remarkably improved strength and modulus of elasticity, uniform in the quality and having excellent physical properties can be produced.

The acrylonitrile copolymer fibers to be used in the present invention are those produced by conventional spinning process such as, for example, wet-spinning process, dry-spinning process or dry/wet-spinning process from an acrylonitrile copolymer containing at least 80 mol % or preferably more than 90 mol % of acrylinitrile and copolymerized with 0.3 to 6 mol % or preferably 0.5 to 3 mol % of an unsaturated monomer containing a carboxyl group. In case the content of the copolymerized unsaturated monomer containing carboxyl group is less than 0.3 mol %, the effects of this invention i.e., shortening of the heat treatment time and improvement of the physical properties of the resulting carbon fibers will not be able to be well attained, and, in case it exceeds 6 mol %, it will be difficult to produce fibers having sufficient physical properties as precursors for the production of carbon fibers and further there is seen no sufficient improvement in the physical properties in the resulting carbon fibers.

Among such carboxyl group-containing unsaturated monomers to be copolymerized with acrylonitrile, there are acrylic acid, methacrylic acid, ethacrylic acid, crotonic acid, isocrotonic acid, itaconic acid, maleic acid, mesaconic acid, citraconic acid and their water-soluble salts (alkali metal salts and ammonium salts). Acrylonitrile copolymer fibers containing a specific amount of carboxyl groups and their salts to be used in the present invention may be produced by forming fibers from a copolymer obtained by copolymerizing acrylonitrile with a mixture of the above mentioned unsaturated carboxylic acid and unsaturated carboxylic acid salt in the proper proportions.

If desired, 0 to 14 mol % of any other unsaturated monomer can be copolymerized with the acrylonitrile and carboxyl group-containing unsaturated monomer. As such other unsaturated monomers, there can be enumerated well known ethylenically unsaturated compounds such as alkyl alcohol, methallyl alcohol β-hydroxypropyl acrylonitrile, methacrylonitrile, α-methyleneglutaronitrile, isopropenyl acetate, acrylamide, dimethylaminoethyl methacrylate, vinylpyridine, vinylpyrrolidone, methyl acrylate, methyl methacrylate, vinyl acetate, acryl chloride, sodium methallylsulfonate and potassium p-styrenesulfonate.

Further, the acrylonitrile copolymer may be produced by well known polymerization system such as solution polymerization system, bulk polymerization system, emulsion polymerization system or suspension polymerization system. As solvents in the case of producing acrylonitrile copolymer fibers from such copolymer, there may be used organic solvents such as dimethylformamide, dimethylacetamide and dimethyl sulfoxide and inorganic solvents such as aqueous solutions of nitric acid, zinc chloride and thiocyanate.

The copolymer may be spun into fibers in an ordinary and well known manner.

The acrylonitrile copolymer fibers containing carboxyl groups (-COOH) and salts thereof (-COOX) in specific predetermined amounts according to the present invention can be obtained by any suitable method. For example, in the case of using an acrylonitrile copolymer copolymerized with an unsaturated carboxylic acid, there may be employed a method wherein said copolymer or the fiber obtained from said copolymer is treated with an aqueous solution containing an alkali metal cation or ammonium ion. In case of using an acrylonitrile copolymer copolymerized with an alkali metal salt or ammonium salt of an unsaturated carboxylic acid, there may be employed a method wherein said copolymer or the fiber obtained from said copolymer is treated with an acid aqueous solution. It is also possible, as already mentioned, to employ a method wherein the ratio of carboxyl groups and salts thereof in the fiber is adjusted by properly mixing the unsaturated carboxylic acid and the unsaturated carboxylic acid salt for the copolymerization with acrylonitrile. Regardless of the method used, any acrylonitrile copolymer fibers in which 0.1 to 15 % of terminal hydrogens of carboxyl groups (-COOH) in the fibers is replaced with an alkali metal cation or ammonium ion may be used in this invention. Particularly, as a preferable process for producing the fibers to be used in the present invention, there can be enumerated a process wherein gel fibers in a water-swollen state obtained by spinning an acrylonitrile copolymer copolymerized with an unsaturated carboxylic acid are treated with an aqueous solution containing an alkali metal cation or ammonium ion so that a part of the carboxyl group (-COOH) in said fibers is converted to a salt form (-COOX). In this case, the treating condition may vary remarkably depending on the kind of the solvent to be used to form the fibers, the kind of the cation and the oriented state of the gel fibers. Anyhow, it is necessary that the acrylonitrile copolymer fibers to be used in the present invention should be those wherein 0.1 to 15 mol % or preferably 0.5 to 10 mol % of the carboxyl groups contained in said fibers is in the form of a salt (-COOX).

In producing carbon fibers from the thus obtained acrylonitrile copolymer fibers containing carboxyl groups (-COOH) and salts thereof (-COOX) at specific or predetermined proportions there can be employed any known conventional process. However, it is generally preferable to employ a firing or heating process which comprises a primary firing step (so-called thermal stabilization step) wherein the fibers are heated to 150° to 400° C. in an oxidizing atmosphere to effect the cyclization (a cyclized structure of a polynaphtyridine ring is formed in the fiber) and a secondary firing step wherein the fibers are then heated at a high temperature (usually above 800° C.) in a non-oxidizing atmosphere or under a reduced pressure so as to be carbonized or carbonized and graphitized.

For the thermal-stabilization step air is preferable as the atmosphere but there can be used another process wherein the fibers are thermally stabilized in the presence of sulfur dioxide or nitrogen monoxide gas or under the radiation of rays. The carbonization is conducted generally at a temperature of 800° to 200° C. In order to further graphitize the obtained carbon fibers, the fibers are heated generally to a temperature of 2,000° to 3500° C. As such carbonizing or graphitizing atmosphere, there is preferably used nitrogen, hydrogen, helium or argon. Further, for the production of carbon fibers of a higher strength and modulus of elasticity, it is preferable to conduct the heating under a tension. It is particularly effective to apply a tension at the time of conducting the thermal-stabilization and also at the time of carbonizing or graphitizing the fibers. The carbonization or graphitization may be carried out under a reduced or increased pressure.

According to the present invention, it is possible to produce carbon fibers very excellent in the strength and modulus of elasticity and the resulting carbon fibers can be used, for example, as reinforcing materials, heating elements and heat-resistant materials.

The invention will be further explained by means of the following Examples in which the percentages and parts are by weight unless otherwise specified.

EXAMPLE 1

Twelve parts of an acrylonitrile copolymer consisting of 98 mol % acrylonitrile and 2 mol % methacrylic acid and obtained by an aqueous suspension polymerization process by using $(NH_4)_2S_2O_8/Na_2SO_3$ redox catalyst were dissolved in 88 parts of a 46 % aqueous solution of sodium thiocyanate to prepare a spinning solution. The spinning solution was extruded into a coagulating bath consisting of a 12 % aqueous solution of sodium-thiocyanate at −3° C. and adjusted to pH 4 by $H_2SO_4$, through a spinnerette of 50 orifices (orifice diameter 0.06 mm.). The content of $Na_2SO_4$ in the coagulating bath was varied. Then the obtained gel fibers were well washed with water, then stretched 5 times the length in boiling water, and further stretched twice the length in superheated steam, and were then dried to obtain acrylonitrile copolymer fibers of a strength of 6.2 g./d. and Young's modulus of 89 g./d.

The thus obtained various acrylonitrile copolymer fibers resulting from different $Na_2SO_4$ concentrations in the coagulating bath were respectively heated to obtain four kinds of carbon fibers. Thus the fibers were heated by continuously elevating the temperature for 20 minutes from 200° C. to 300° C. in an air atmosphere with an electric furnace to obtain thermal-stabilized fibers. Further, these thermally stabilized fibers were carbonized by continuously elevating the temperature for 100 minutes to 1200° C. in a nitrogen gas atmosphere.

Then the strength and moduli of elasticity of the obtained four kinds of carbon fibers were measured and the results are shown in Table 1. As apparent from Table 1, according to the present invention, the strength and modulus of elasticity of carbon fibers can be remarkably improved.

On the other hand, when fibers made from an acrylonitrile copolymer copolymerized with 2 mol % methyl acrylate were heated in the same manner as mentioned above, the fibers remarkably fused together and the obtained carbon fibers were brittle so that their physical properties could not be measured.

Table 1

| Acrylonitrile copolymer fibers | | | Carbon fibers | |
|---|---|---|---|---|
| No. | $Na_2SO_4$ concentration in coagulating bath (%) | *Na conversion rate (mol %) | Strength (kg./mm²) | Modulus of elasticity (tons/mm²) |
| 1 | 0 | 9.7 | 258 | 24 |
| 2 | 0.1 | 14.1 | 237 | 22 |
| 3 | 1.0 | 40.1 | 183 | 14 |
| 4 | 5.0 | 56.5 | 166 | 13 |

*The rate of the conversion of the carboxyl groups (-COOH) in the fibers to the salt form (-COONa).

EXAMPLE 2

A spinning solution obtained by dissolving 12 parts of an acrylonitrile copolymer consisting of 97 mol % acrylonitrile, 2 mol % acrylic acid and 1 mol % methyl acrylate in 88 parts of a 46 % aqueous solution of sodium thiocyanate was extruded into a 12 % aqueous solution of sodium thiocyanate at − 3° C. through a spinnerette. Then the obtained gel fibers were well washed with water and were then treated with an aqueous solution of hydrochloric acid of various concentrations. The thus treated gel fibers were stretched and dried in the same manner as in Example 1 to obtain acrylonitrile copolymer fibers of a strength of 6.1 g./d. and Young's modulus of 87 g./d.

The thus obtained various fibers (different in the Na conversion rate of the carboxyl group terminal hydrogen) were fired or heated under the same conditions as in Example 1 to obtain four kinds of carbon fibers. The physical properties of such carbon fibers are shown in Table 2. It is apparent therefrom that the physical properties of carbon fibers can be remarkably improved by converting a certain amount of carboxyl groups in acrylonitrile copolymer fibers to salt form (-COOX) according to the present invention.

Table 2

| Acrylonitrile copolymer fibers | | | Carbon fibers | |
|---|---|---|---|---|
| No. | Acid treatment (pH) | Na conversion (mol %) | Strength (kg./mm²) | Modulus of elasticity (tons/mm²) |
| 1 | 1 | 0 | 191 | 16 |
| 2 | 2 | 2.3 | 265 | 24 |
| 3 | 3 | 13.1 | 227 | 23 |
| 4 | 5 | 26.8 | 164 | 14 |

EXAMPLE 3

A spinning solution obtained by dissolving 18 parts of an acrylonitrile copolymer consisting of 96 mol % acrylonitrile and 4 mol % methacrylic acid in 82 parts of dimethyl-formamide was wet-spun into a 60 % aqueous solution of dimethylformamide through a spinnerette. Then the obtained gel fibers were well washed with water, then treated with an alkaline aqueous solution (25° C.) set at various pH values by using KOH. Then the fibers were stretched 3.5 times the length in hot water, and further stretched twice the length in superheated steam and were then dried to obtain acrylonitrile copolymer fibers of various salt form (-COOK) conversion rates.

Then the obtained fibers were respectively fed into an electric furnace of an effective length of 106 cm. having a continuous temperature gradient from 200° C. to 305° C. The fibers were passed through the furnace continuously at a velocity of 6 cm./min. to be primarily fired in an air atmosphere and were then continuously carbonized in a nitrogen gas atmosphere by using the same furnace at a temperature from 300° C. to 1200° C.

The strengths and moduli of elasticity of the thus obtained various carbon fibers were measured. The results are shown in Table 3. It will be observed from Table 3 that, by converting a certain amount of carboxyl groups in acrylonitrile copolymer fibers to the salt form (-COOK), the physical properties of the obtained fibers are improved.

Table 3

| Acrylonitrile copolymer fibers | | | Carbon fibers | |
|---|---|---|---|---|
| No. | pH of alkaline aqueous solution | K conversion rate (mol %) | Strength (kg./mm²) | Modulus of elasticity (tons/mm²) |
| 1 | 7 | 0 | 185 | 17 |
| 2 | 8 | 2.1 | 256 | 22 |
| 3 | 9 | 4.1 | 249 | 22 |
| 4 | 10 | 5.9 | 260 | 23 |

What is claimed is:

1. In a process for producing carbon fibers having a high strength and a high modulus of elasticity which comprises heating acrylonitrile copolymer fibers made from an acrylonitrile copolymer containing at least 80 mole % acrylonitrile, the improvement wherein the acrylonitrile copolymer contains 0.3 to 6 mole % of an unsaturated carboxylic acid and its alkali metal or ammonium salt, and the content of the carboxylic groups in the salt form in the fiber is 0.1 to 15% based on the total amount of carboxyl groups and their salts in the fiber.

2. A process according to claim 1 wherein there are used acrylonitrile copolymer fibers which are made from an acrylonitrile copolymer produced by copolymerizing at least 80 mol % acrylonitrile and 0.5 to 6 mol % of an unsaturated monomer containing a carboxyl group and in which 0.5 to 10 % of the terminal hydrogens of said carboxyl groups have been replaced with an alkali metal cations or ammonium ions.

3. A process according to claim 1 wherein said acrylonitrile copolymer contains at least 90 mol % acrylonitrile.

4. A process according to claim 1 wherein said acrylonitrile copolymer fibers are obtained by treating acrylonitrile copolymer fibers in a water-swollen state obtained by wet-spinning an acrylonitrile copolymer produced by copolymerizing at least 80 mol % acrylonitrile and 0.3 to 6 mol % of an unsaturated monomer containing a carboxyl group, with an aqueous solution containing an alkali metal cation or ammonium ion.

5. A process according to claim 1 wherein said acrylonitrile copolymer fibers are obtained by treating acrylonitrile copolymer fibers in a water-swollen state obtained by wet-spinning an acrylonitrile copolymer produced by copolymerizing at least 80 mol % acrylonitrile and 0.3 to 6 mol % of an unsaturated monomer containing a carboxyl group by using an aqueous solution of thiocyanate as a solvent, with an acid aqueous solution.

6. A process according to claim 1 wherein said unsaturated monomer containing carboxyl group is selected from the group consisting of acrylic acid, methacrylic acid, ethacrylic acid, crotonic acid, isocrotonic acid, itaconic acid, maleic acid, mesaconic acid, or citraconic acid.

7. A process according to claim 1 wherein said acrylonitrile copolymer fibers are thermally stabilized in an oxidizing atmosphere at a temperature of 150 to 400° C. and are then carbonized in a non-oxidizing atmosphere at a temperature of 800° to 2000° C.

8. A process according to claim 7 wherein said oxidizing atmosphere is air.

9. A process as claimed in claim 7 wherein said non-oxidizing atmosphere is nitrogen.

10. A process as claimed in claim 7 wherein the thermally stabilized fibers are carbonized in a nonoxidizing atmosphere at a temperature of 800° to 2000° C. and are then graphitized in a non-oxidizing atmosphere at a temperature of 2000° to 3500° C.

* * * * *